US009370673B2

(12) United States Patent
Church

(10) Patent No.: US 9,370,673 B2
(45) Date of Patent: Jun. 21, 2016

(54) CHIMNEY ACCESS DEVICE AND METHOD

(71) Applicant: John Edwin Church, Carlotta, CA (US)

(72) Inventor: John Edwin Church, Carlotta, CA (US)

( * ) Notice: Subject to any disclaimer, the term of this patent is extended or adjusted under 35 U.S.C. 154(b) by 0 days.

(21) Appl. No.: 14/606,783

(22) Filed: Jan. 27, 2015

(65) Prior Publication Data

US 2015/0209603 A1 Jul. 30, 2015

Related U.S. Application Data

(60) Provisional application No. 61/931,942, filed on Jan. 27, 2014.

(51) Int. Cl.

| | |
|---|---|
| ***A62C 3/00*** | (2006.01) |
| ***A62C 3/04*** | (2006.01) |
| ***A62C 13/76*** | (2006.01) |
| ***A62C 31/00*** | (2006.01) |

(52) U.S. Cl.
CPC . *A62C 3/04* (2013.01); *A62C 13/76* (2013.01); *A62C 31/00* (2013.01)

(58) Field of Classification Search
None
See application file for complete search history.

(56) References Cited

U.S. PATENT DOCUMENTS

| | | | | |
|---|---|---|---|---|
| 4,341,267 | A * | 7/1982 | Lagasse | A62C 3/04 169/51 |
| 4,664,197 | A * | 5/1987 | Leduc | A62C 3/00 169/19 |
| 4,736,801 | A * | 4/1988 | Grewell | A62C 3/04 169/52 |
| 4,872,513 | A | 10/1989 | Gardner | |
| 5,211,118 | A | 5/1993 | Perkins | |
| 5,458,201 | A | 10/1995 | Brim | |
| 5,921,323 | A * | 7/1999 | Cronk | A62C 4/04 169/54 |
| 2013/0146316 | A1 | 6/2013 | Griffith | |
| 2013/0186655 | A1 | 7/2013 | Mauney | |

FOREIGN PATENT DOCUMENTS

| | | |
|---|---|---|
| CA | 1200796 | 2/1986 |

* cited by examiner

*Primary Examiner* — Len Tran
*Assistant Examiner* — Adam J Rogers
(74) *Attorney, Agent, or Firm* — Eric Karich; Karich & Associates

(57) ABSTRACT

A chimney access device has a rigid tube and a resilient connection tubing. The resilient connection tubing is connected with the proximal end of the rigid tube. The nozzle of the fire extinguisher may be inserted into the resilient connection tubing for spraying the extinguishant from the fire extinguisher through the rigid tube and into a chimney.

1 Claim, 2 Drawing Sheets

CHIMNEY ACCESS DEVICE AND METHOD

CROSS-REFERENCE TO RELATED APPLICATIONS

This application for a utility patent claims the benefit of U.S. Provisional Application No. 61/931,942, filed Jan. 27, 2014.

BACKGROUND OF THE INVENTION

1. Field of the Invention

This invention relates generally to fire extinguisher accessories, and more particularly to adaptors or nozzles for directing extinguishant from fire extinguishers.

2. Description of Related Art

Chimney fires are a known hazard that can be responsible for significant property damage and injury to homeowners or emergency personnel. The heat in a chimney fire may be extreme due to the confined space and the ready flow of air through the chimney to fuel the fire. The present invention provides a way to direct the extinguishant up into the chimney in an efficient manner, while remaining at a safe distance from the chimney.

Prior art devices have been designed to attempt to perform this function. Gardner, U.S. Pat. No. 4,872,513, for example, describes a chimney fire extinguisher which includes a small diameter narrow conduit. An aperture must be cut or otherwise provided through the chimney wall so that the conduit may be inserted therethrough and installed. A fire extinguisher is coupled to one end of the conduit for delivery of the extinguishant through the conduit.

Cronk, U.S. Pat. No. 5,921,323, describes a similar chimney fire access device for injecting a fire extinguishing compound into the interior of an elongate vertical chimney stack. This also is installed through an aperture cut in the wall. Also, the fire extinguisher is attached to the device in a manner entirely different from the present invention, so that the portable construction of the present invention would not be possible.

SUMMARY OF THE INVENTION

The present invention teaches certain benefits in construction and use which give rise to the objectives described below.

The present invention provides a chimney access device for spraying extinguishant into a chimney. The chimney access device includes a rigid tube and a resilient connection tubing. The resilient connection tubing is connected with the proximal end of the rigid tube. The nozzle of the fire extinguisher may be inserted into the resilient connection tubing for spraying the extinguishant from the fire extinguisher through the rigid tube and into the chimney.

A primary objective of the present invention is to provide a chimney access device having advantages not taught by the prior art.

Another objective is to provide a chimney access device that may be used with a standard fire extinguisher for extinguishing fires in a chimney.

A further objective is to provide a chimney access device that enables a person to extinguish such fires while reducing the danger of burns, smoke inhalation, or other injury.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a chimney access device 10 for spraying extinguishant 11 into a chimney 16.

Figure 1:
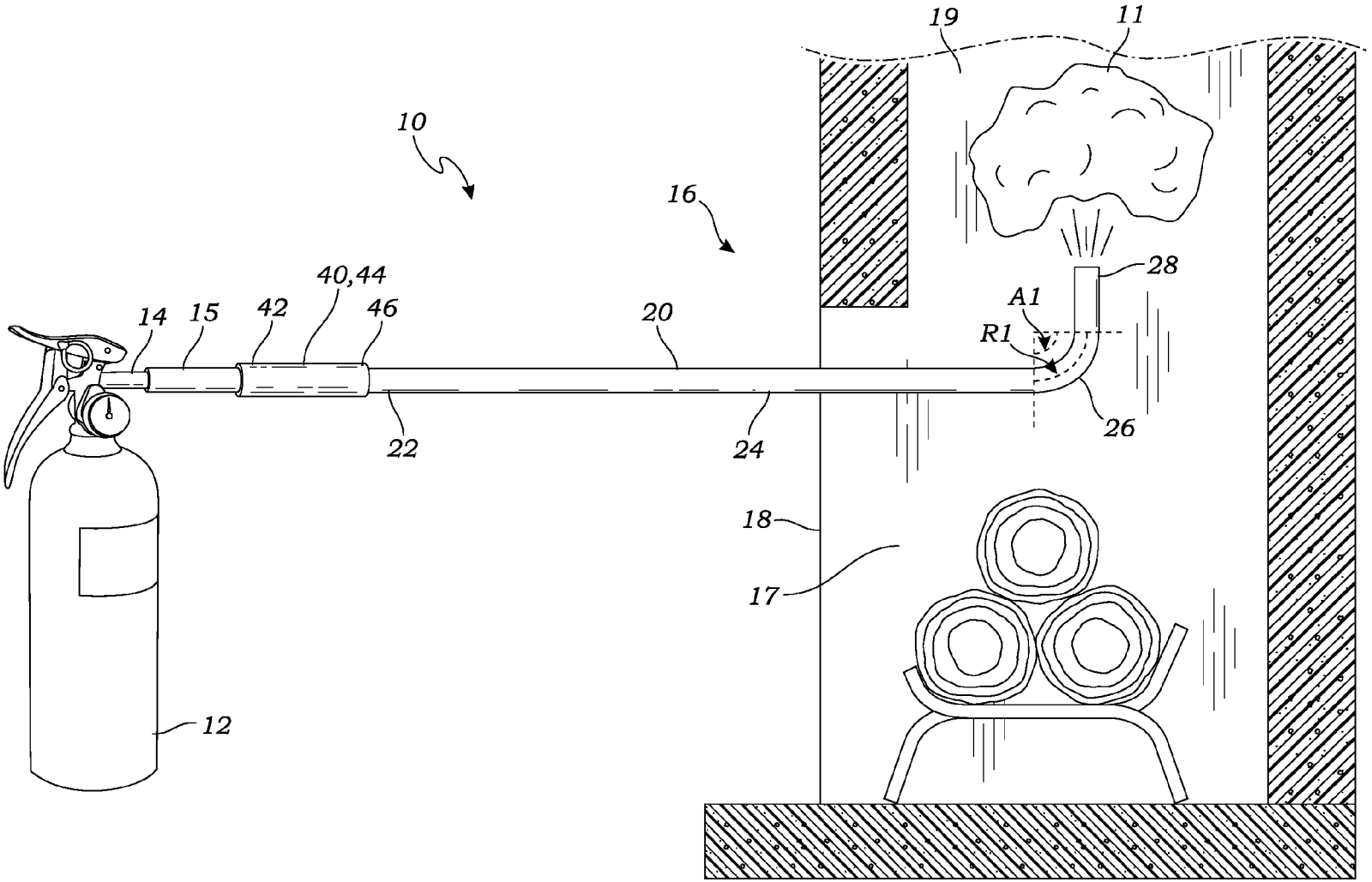
FIG. 1 is a side elevational view of a chimney access device, illustrating extinguishant from a fire extinguisher being sprayed into the chimney shaft.

FIG. 1 is a side elevational view of the chimney access device 10, illustrating the extinguishant 11 from a fire extinguisher 12 being sprayed into a chimney shaft 19 of the chimney 16. In the embodiment of FIG. 1, the chimney access device 10 includes a rigid tube 20, and a resilient connection tubing 40 for connecting the rigid tube 20 to the fire extinguisher 12. The device 10 may be used in conjunction with a standard fire extinguisher 12 of known construction, and having a fire extinguisher nozzle 14 for spraying the extinguishant 11.

As shown in FIG. 1, the chimney 16 has a firebox 17, a primary firebox opening 18, and a chimney shaft 19. The firebox 17 is the lower portion where wood or other combustibles are typically burned. The firebox opening 18 is the large primary opening to the firebox 17, through which wood is loaded, fire viewed, etc. The chimney shaft 19 is the typically vertical shaft through which smoke from the chimney 16 escapes to the outside. By means of the present invention, the extinguishant 11 may be sprayed upward into the chimney shaft 19 to reach the chimney fire. Importantly, the device 10 may be inserted through the primary firebox opening 18, without requiring any small apertures to be cut or otherwise provided for installation of the device 10 therethrough, as is common in the prior art.

The rigid tube 20 may have a proximal end 22, an elongate tube body 24, a bent portion 26, and a distal end 28. The proximal end 22 is the portion of the rigid tube 20 which is closest to the user when the chimney access device 10 is being used to extinguish a fire. The proximal end 22 may be fitted to the resilient connection tubing 40 as described in the discussion of FIG. 2, below. The rigid tube 20 may be of any material suitable for transmission of the extinguishant 11, such as aluminum, steel, copper, brass, etc. There may be more than one material used in the construction, such as a break with a material that may act as a thermal insulator, such as a high-melting temperature polymer or other material that would reduce the conduction of heat from the distal end 28 to the proximal end 22.

The elongate tube body 24 is the portion of the rigid tube 20 is used to keep the user a safe distance from the firebox opening 18 when extinguishing a fire. The elongate tube body 24 separates the proximal end 22 and the distal end 28, which is placed in the chimney 16. The elongate tube body 24 may be of varying lengths according to one skilled in the art, depending on the weight of the materials that constitute the chimney access device 10, and the safe distance desired by the user.

The bent portion 26 is a curved section which translates the spray of the extinguishant 11 from a generally horizontal direction to a generally vertical direction, into the chimney shaft 19, to reach the chimney fire. The bent portion 26 may have a variety of shapes according to one skilled in the art, and in one embodiment the bent portion 26 may have only one bend defined by a bend radius R1 and a bend angle A1. In the present embodiment, the bend angle A1 is approximately 90 degrees. In other embodiments, the bend angle A1 may have other values, such as between 50 to 130 degrees (or other configuration deemed suitable by one skilled in the art), for introducing the extinguishant 11 into the chimney shaft 19 or other enclosure at the desired angle. For purposes of this application, the term "approximately" is defined to mean +/−10%.

The distal end 28 is the end closest to the chimney fire and is where the extinguishant 11 is sprayed from the chimney access device 10. The distal end 28 may be of a simple tubular construction, or may be conical or any other shaping desired by one skilled in the art for the efficient spraying of the extinguishant 11 into the chimney shaft 19.

The resilient connection tubing 40 may be used to connect the rigid tube 20 to the fire extinguisher nozzle 14. The resilient connection tubing 40 may have a first end 42, an elongate body 44, and a second end 46. The first end 42 and the second end 46 may be structurally identical cylindrically shaped ends for accepting the rigid tube 20 and the fire extinguisher nozzle 14, respectively. The second end 46 of the resilient connection tubing 40 may be frictionally fit around the proximal end 22 of the rigid tube 20. This requires the resilient connection tubing 40 to have some degree of elasticity. Materials suited for this purpose may include rubber, foam rubber, or flexible plastic. Another embodiment may have an outer layer (not shown) of the resilient connection tubing 40 be metal or other rigid stock, with a flexible inner layer (not shown) for providing a tight grasp on the inserted component.

The fire extinguisher nozzle 14 may have a nozzle end 15, where the nozzle end 15 may be inserted into the first end 42 of the resilient connection tubing 40 for spraying the extinguishant 11 from the fire extinguisher 12 through the rigid tube 20 and into the chimney 16. The nozzle end 15 may be adapted to fit inside the resilient connection tubing 40, as described in FIG. 2, below, by either a loose fit, a press fit, any sort of frictional fit, a threaded connection (not shown), or any other connecting means known to one skilled in the art.

Figure 2:
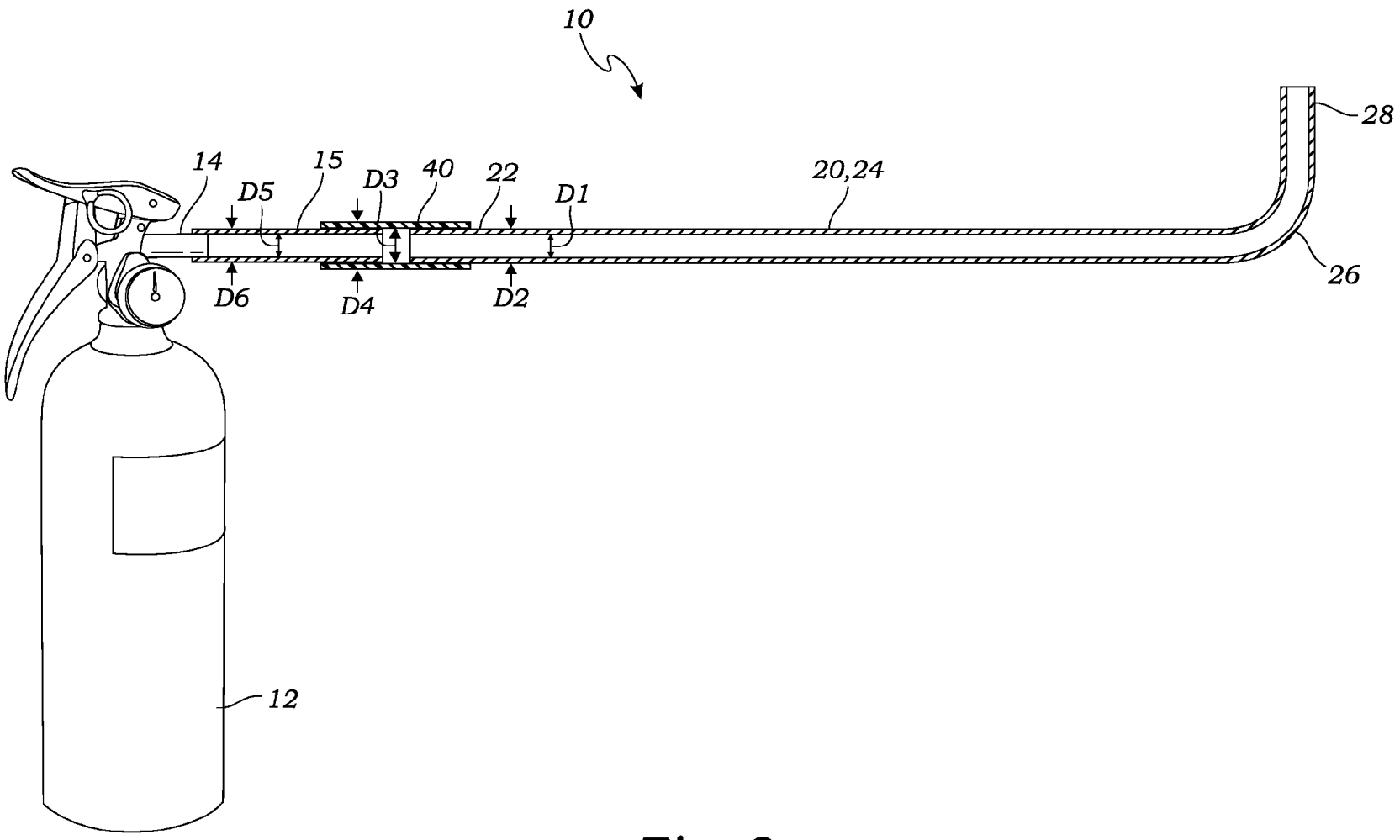
FIG. 2 is a sectional view of the chimney access device.

FIG. 2 is a sectional view of the chimney access device 10. As shown in FIG. 2, the rigid tube 20 may have an inner diameter D1 and an outer diameter D2, the resilient connection tubing 40 may have an inner diameter D3 and an outer diameter D4, and the fire extinguisher nozzle 14 may have an inner diameter D5 and an outer diameter D6.

In the present embodiment, the cross section of the rigid tube 20 is circular, though other cross sections are possible, for example, square, hexagonal, etc. For other cross-sections the inner diameter D1 and the outer diameter D2 may be taken to be the diameter of the smallest circumscribed circle and smallest inscribed circle, respectively. The inner diameter D1 and the outer diameter D2 may be the same throughout the rigid tube 20, though variation is possible, for example, the inner diameter D1 and the outer diameter D2 at the distal end 28 may be larger if a conical nozzle shape was desired.

In general, the walls should be kept fairly thin in order to provide a lightweight device, particularly since the elongate tube body 24 of the rigid tube 20 may extend some distance away from the user and would be difficult to use, if of heavy construction. As stated in the description of FIG. 1, the rigid tube 20 and the fire extinguisher nozzle 14 may be coupled via a press fit with the resilient connection tubing 40. This requires that the outer diameter D2 of the proximal end 22 of the rigid tube 20 to be slightly greater than the inner diameter D3 of the resilient connection tubing 40. Similarly, the outer diameter D6 of the nozzle end 15 may be larger than the inner diameter D3 of the resilient connection tubing 40. Alternatively, D6 may be smaller than D3, and the fire extinguisher 12 and the resilient connection tubing 40 may be held together by the user. Other means of coupling, not shown here, may include threads, locks, clasps, clamps, etc. Also, the diameters of the various components may be varied according to one skilled in the art for accommodating different configurations or devices. For example, if the outer diameter D2 of the rigid tube 20 is larger than the outer diameter D6 of the fire extinguisher nozzle 14, the inner diameter D3 of the resilient connection tubing 40 at the first end 42 may be smaller than the inner diameter D3 at the second end 46. This may be particularly important for using the resilient connection tubing 40 to adapt the chimney access device 10 for use with different types of fire extinguishers 12.

The present invention also includes a method of use, for extinguishing the chimney fire, whereby first, the fire extinguisher 12, the rigid tube 20, and the resilient connection tubing 40 is provided. The proximal end 22 of the rigid tube 20 may be inserted into the second end 46 of the resilient connection tubing 40. The fire extinguisher nozzle 14 of the fire extinguisher 12 may be inserted into the first end 42 of the resilient connection tubing 40. Then, the chimney access device 10, thus assembled, may have the second end 28 inserted into the firebox 17 via the firebox opening 18. An advantage of the present device 10 is that it is inserted into the firebox 17 through the firebox opening 18 (i.e., the opening that is used to insert logs etc. into the firebox 17), so that no special aperture need be but through the chimney. Finally, the extinguishant 11 may be sprayed from the fire extinguisher nozzle 14, through the resilient connection tubing 40 and the rigid tube 20, and into the chimney shaft 19 to extinguish the chimney fire.

As used in this application, the word about, when applied to numerical values, is hereby defined include an uncertainty of +/−10% of the stated value, to reflect approximations which may result from the manufacturing process or other sources of error.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

I claim:

1. A chimney access device for spraying extinguishant into a chimney having a firebox, a firebox opening, and a chimney shaft, from a fire extinguisher having a nozzle, the chimney access device consisting of:

a rigid tube having a proximal end, an elongate tube body, a bent portion having a bend angle of approximately 90 degrees, and a distal end;

a resilient connection tubing having an elongate body, a first end, and a second end, the second end of the resilient connection tubing being frictionally fit around the proximal end of the rigid tube such that the resilient connection tubing may be removably engaged with the rigid tube; and wherein the nozzle of the fire extinguisher may be inserted into and frictionally engaged with the first end of the resilient connection tubing for spraying the extinguishant from the fire extinguisher through the rigid tube and into the chimney.

* * * * *